United States Patent [19]

Smallegan et al.

[11] Patent Number: 4,834,432

[45] Date of Patent: May 30, 1989

[54] DUAL BACKSET LATCH

[75] Inventors: Jon M. Smallegan, San Mateo; Keith L. Mathews, San Francisco, both of Calif.

[73] Assignee: Schlage Lock Company, San Francisco, Calif.

[21] Appl. No.: 109,100

[22] Filed: Oct. 16, 1987

[51] Int. Cl.[4] ..... E05C 1/16

[52] U.S. Cl. ..... 292/169.21; 292/337; 292/DIG. 60

[58] Field of Search ..... 292/337, DIG. 60, 169.13–169.23, 292/352, 172; 70/451, 1

[56] References Cited

U.S. PATENT DOCUMENTS

| | | | |
|---|---|---|---|
| 3,751,085 | 8/1973 | Sanders et al. | 292/169.15 |
| 3,971,239 | 7/1976 | Lavis | 292/337 |
| 4,301,667 | 11/1981 | Best et al. | 292/169.15 |
| 4,427,224 | 1/1984 | Bergen | 292/169.23 |
| 4,489,576 | 12/1984 | Mullich et al. | 292/DIG. 60 |
| 4,593,542 | 6/1986 | Rotondi et al. | 292/DIG. 60 |
| 4,602,490 | 7/1986 | Glass et al. | 292/DIG. 60 |
| 4,615,549 | 10/1986 | Couture | 292/169.21 |
| 4,639,025 | 1/1987 | Fann et al. | 292/DIG. 60 |
| 4,653,787 | 3/1987 | Fang | 292/169.14 |
| 4,656,849 | 4/1987 | Rotondi et al. | 70/451 |
| 4,664,433 | 5/1987 | Solovieff | 292/173 |
| 4,687,239 | 8/1987 | Lin | 292/DIG. 60 |
| 4,708,379 | 11/1987 | Ching | 292/DIG. 60 |
| 4,711,477 | 12/1987 | Fann et al. | 292/337 |
| 4,718,706 | 1/1988 | Fang | 292/169.13 |

FOREIGN PATENT DOCUMENTS

| | | | |
|---|---|---|---|
| 115430 | 8/1984 | European Pat. Off. | 292/169.14 |

*Primary Examiner*—Gary L. Smith
*Assistant Examiner*—Eric K. Nicholson
*Attorney, Agent, or Firm*—Walter C. Vliet

[57] ABSTRACT

The dead bolt assembly of this invention features a novel cam activating assembly which permits election of one of two door knob spindle backsets which are in standard usage without the need for substituting different operating assemblies or reversing cylinder or thumbturn spindle components. The cam activating assembly features two parallel rotatably mounted cams which operate about two separate and parallel axes which are the centers of the two spindle backset in common industry usage. The two cams accept the door cylinder drive bar in one of the two predetermined backset positions. Each cam is capable of independently operating the latchbolt in either direction of rotation through coupled opposed cam surface which coact with the latch operating plate in conjunction with a coupling idler to convert the rotary motion of the cams to the reciprocating motion required to extend or retract the bolt.

7 Claims, 3 Drawing Sheets

FIG. 1
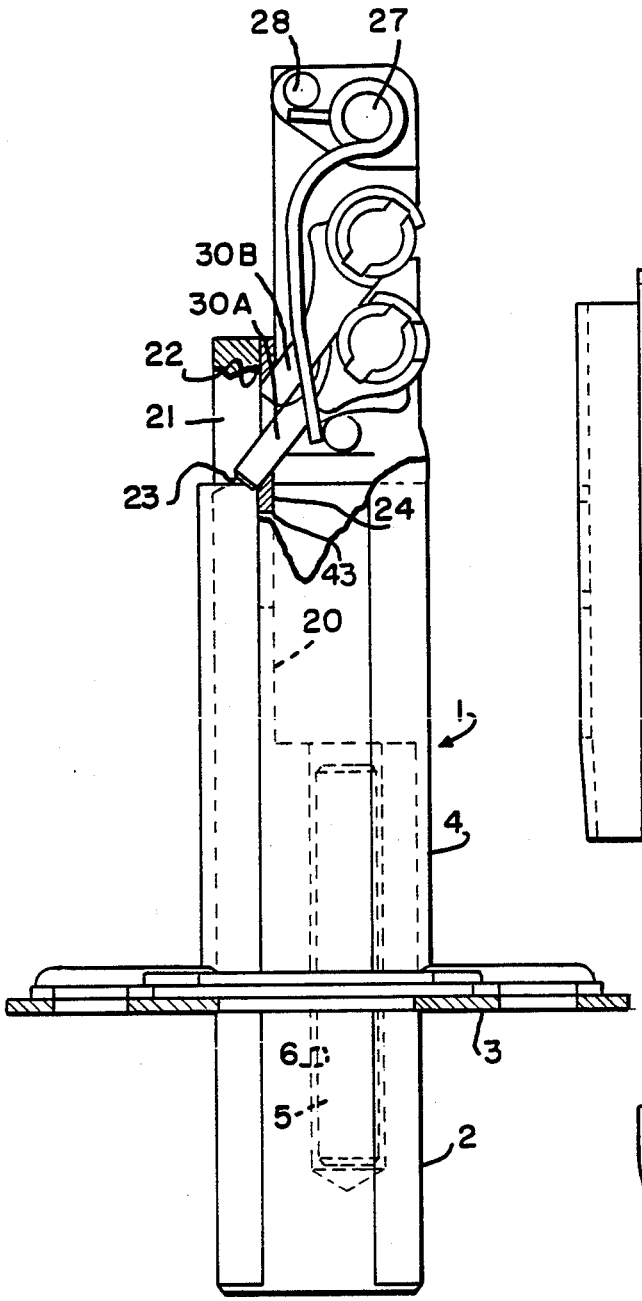
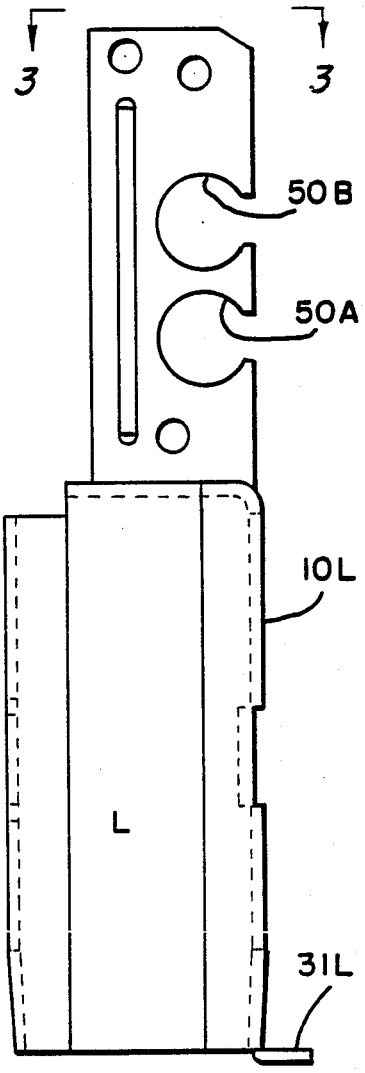
FIG. 2
FIG. 3
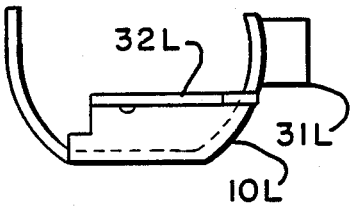

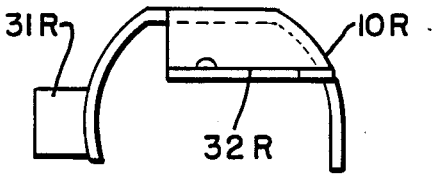
FIG. 5
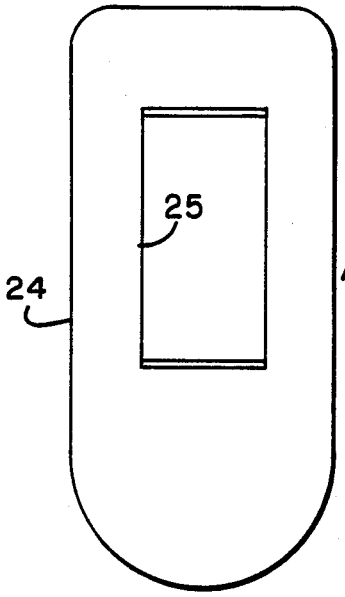
FIG. 6
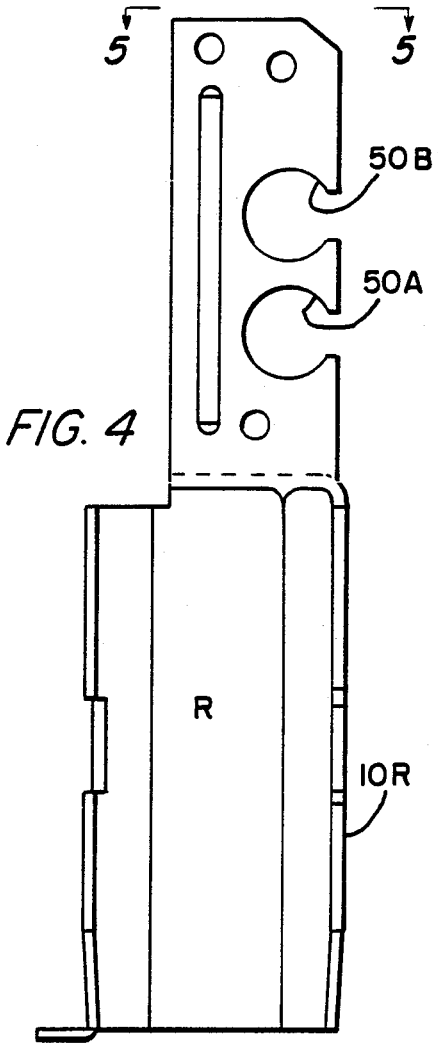
FIG. 4
FIG. 7
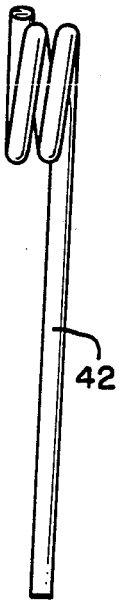
FIG. 8
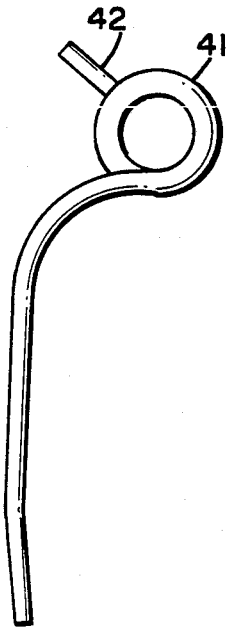

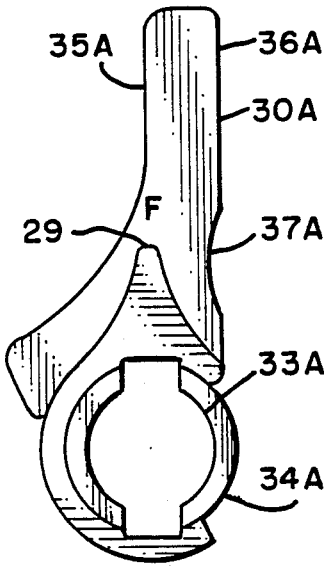
FIG. 9
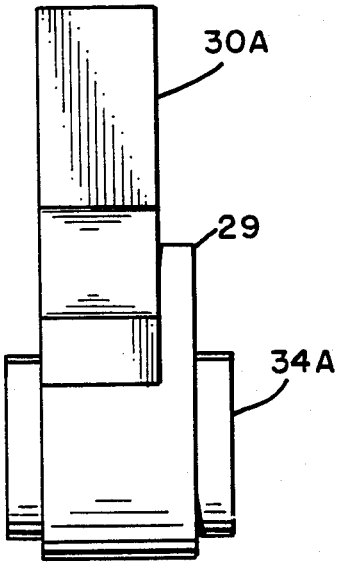
FIG. 10
FIG. 11
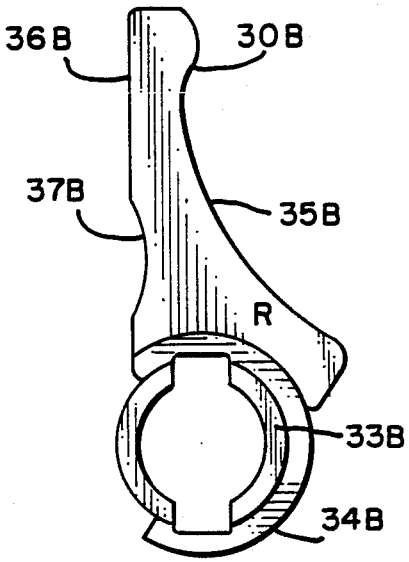
FIG. 12
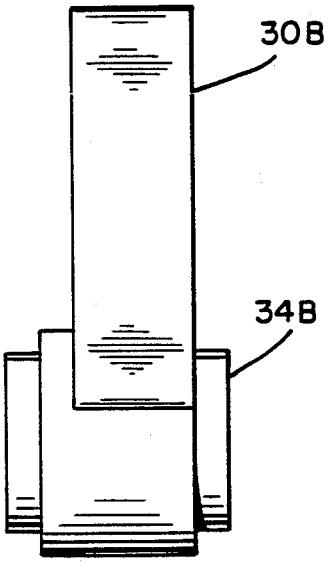

DUAL BACKSET LATCH

BACKGROUND OF THE INVENTION

In conventional usage in door mounted dead bolt construction the so called backset measurement is the distance from the edge of the door in which the bolt is mounted to the transverse axis about which the bolt operator, usually a cylinder drum bar, rotates for extending and retracting the bolt. Backset is measured perpendicularly from the door edge. Backset has for the most part been standardized by theindustry. Two prevailing measurements for backset are 2 and ⅜ inches and 2 and ¾ inches. In the past, most manufacturers of dead bolt constructions have satisfied the demand for the two alternative backset positions by producing and marketing two different and distinctive models of bolt construction. There is a distinct need in the industry for a dead bolt construction which provides the alternate backset selection without the need for substituting parts and/or requiring disassembling the dead bolt mechanism or the use of special shaped dead bolts. Due to the number of non-expert installers in the field, it is necessary that the selection of backset be simple, reliable and easy-to-accomplish without the need for substitute parts or complicated assembly and reassembly of interconnected parts.

OBJECTS AND SUMMARY OF THE PRESENT INVENTION

It is therefore an object of this invention to provide a dead bolt assembly o the type for door mounting and the like having integrated therein a unique backset adjustment feature which permits simple selection of the appropriate mounting backset between at least two dimensions.

These and other objects are obtained in a dead bolt construction for mounting in doors and the like of the general type having a dead bolt longitudinally reciprocating in a door mounting casing between a forward extended position projecting from a door edge and a rearward retracted position substantially fully within the door edge, dead bolt operating means in the casing having a longitudinally forward end operably connected to the bolt and a longitudinally rearward end operably connected to an an acutation means, the actuating means being rotatable about a transverse axis to displace the operating means to reciprocate the bolt, the longitudinal distance between the door edge and the transverse axis of the rotating means constituting backset, the improvement comprising plural coupled overlapping element cam means operable about parallel but offset plural transverse axises for connecting the actuating means to the operating means and converting the rotary action of the actuating means to the reciprocating action of the operating means and thereby reciprocating the dead bolt.

DESCRIPTION OF THE DRAWINGS

FIG. 1 is a side elevation view of a dead bolt assembly incorporating a preferred embodiment of the backset adjustment features of the present invention. The dead bolt assembly being shown in bolt extended position;

FIG. 2 is a side elevation showing the details of the left half dead bolt housing shell;

FIG. 3 is a back end view showing the details of the left half dead bolt housing shell;

FIG. 4 is a side elevation showing the details of the right half dead bolt housing shell;

FIG. 5 is a back end view showing the details of the right half dead bolt housing shell;

FIG. 6 is a plan view showing the details of the bolt idler operating plate;

FIG. 7 is a plan view of the bolt spring.

FIG. 8 is a side elevation showing the bolt spring.

FIG. 9 is a side elevation view showing the details of the forward cam.

FIG. 10 is a front end elevation view showing the detals of the forward cam.

FIG. 11 is a side elevation view showing the details of the the rear cam.

FIG. 12 is a back end elevation view showing details of the rear cam.

DESCRIPTION OF THE PREFERRED EMBODIMENT

Referring to FIG. 1 a dead bolt assembly is generally shown as indicated by reference numeeral 1. Dead bolt assemblies of this general type are known in the industry and comprise a generally cylindrical bolt housing which is inserted into a hole in the edge of the door and secured there by means of a face plate 3. Extending axially from the bolt housing is a dead bolt 2, shown in FIG. 1, projecting to the left of face plate 3. The bolt 2 is mounted for reciprocating motion in the bolt housing.

A bolt operating flange or lock bar 20 is connected to the bolt 2 and is provided with a cam follower cavity 21 which may be a rectangular hole having wedge shaped cam surface 22 and 23 formed at each end. One side of the cavity may be open to facilitate fabrication or assembly. The lock bar 20 is also provided with a cam idler cavity 43 which accepts a generally boat shaped idler 24 (best seen in FIG. 6) having a cam cavity 25 which encircles the forward cam 30A and the rear cam 30B. The idler assists in retaining the forward cam 30A and the rear cam 30B in sliding parallel operation throughout the operating cycle. This assures smooth operation and coupling between cams and accomplishes return to the nondriven cam. A hardened steel pin 5 may be inserted in a pin hole 6 as an aid to preventing the sawing of the bolt.

Shown to the left of the bolt housing and attached thereto is the latch works housing 4 which is formed of a two-piece bent plate. Each half of the housing shell 10L and 10R which are side to side mating pairs contain a pair of cam guides, 50A and 50B, which form rotary bearings for the front cam 30A and the rear cam 30B. Disposed for rotation within the cam guides are the forward cam 30A and rear cam 30B. Rotation of either the forward cam 30A or the rear cam 30B results in lineal translation of the bolt lock bar 20 and hence the bolt 2 along the axis of the bolt operating assembly whereby the bolt is extended or retracted. Rotation of either cam in the clockwise direction results in the retraction of bolt 2.

FIG. 3 shows an end of the housing shell 10L showing details of the housing shell configuration, retaining tab 31L and spring guide 32L.

FIG. 4 and FIG. 5 shows the right half of the housing shell 10R. As may be appreciated by one skilled in the art the left hand shell housing and the right hand shell housing may be assembled together and retained by any convenient means such as bent tabs or staking as is common in the lock art.

FIGS. 7 and 8 show the detail of the operating spring 26 which is essentially a bent wire spring which is retained in the housing by means of a shaft stake 27 and a stop stake 28 provided in the spring guides 32L and 32R respectively. Other means of retaining the springs such as bent tabs are suitable and optional construction. As best seen on FIGS. 9 and 10 the front cam 30A is provided with a spring lift cam 29 which serves to lift the end of the spring 26 as the cam 30A is rotated between the bolt extended and bolt retracted position. The spring therefore provides "feel" during translation between the extended and retracted position and further retains the cams in the selected position once set. Both the front cam 30A and the rear cam 30B consist of a basic hub portion 34A and 34B and an operative cam portion 35A and 35B having arcuate configurations which assist in the bolt throw. Each cam is also provided with a parallel interacting portion or straight cam portion 36A and 36B and a relief notch 37A and 37B which is provided for purpose of allowing additional overlap of the cams at either extreme as will be appreciated by once skilled in the art.

On assembly the front cam 30A and rear cam 30B are assembled between the two mating halves of the housing shell 10L and 10R with the hubs 34A and 34B in rotary bearing engagement with cam guides 50A and 50B. The front and rear cams 30A and 30B are therefore oriented in substantially parallel relationship for rotation about two offset but parallel axes formed at the center of the cam guides. The front and rear cam 30A and 30B are retained in this relationship substantially by cam idler 24 and coact with the lock bar 20 at the cam surfaces 22 and 23 to effect translation of the bolts upon rotation of either the front or the rear cam. The angle of cam surfaces 22 and 23 are chosen to interact with the tips of the front and rear cams 30A and 30B such that at the extreme of throw in either direction the bolt is locked against translation and cannot be moved without cam rotation. Cam rotation is typically controlled by an outside lock cylinder and/or an inside lock cylinder or thumb turn.

The wire spring 26 is also installed between the housing shells 10L and 10R and is held in position there by means of a stake 27 through the circular portion of the spring 41 and prevented from rotation through interaction of spring tab 42 with a tab stake 28. In this position the spring 26 applies a force to cam 29 which assists the forward cam to either extreme position and thereby through the idler 24 also positions the rear cam 30B at its extremes and further provides a snap action feel to the dead bolt. The spring 26 further assures the cam tips are rotated into the lock position at each end of the bolt throws as described above, and remain there until the cams are rotated.

A feature of the present invention resides in the use of a one piece bolt 2 and lock bar 20 which provides increased resistance to lateral forces which is an important feature with the greater bolt extension permitted with the present invention.

Having described my invention in terms of a preferred embodiment I do not wish to be limited in the scope of the invention except as claimed.

I claim:

1. A dead bolt construction for mounting in doors of the general type having a dead bolt longitudinally reciprocating in a door mounted casing between a forward extended position projecting from a door edge and a rearward retracted position substantially fully within said door edge; dead bolt operating means in said casing having a longitudinally forward end operably connected to the bolt and a longitudinally rearward end operably connected to an actuation means, said actuation means being rotatable about a transverse axis to displace said operating means to reciprocate the bolt, the longitudinal distance between the door edge and the transverse axis of the rotating means constituting backset, the improvement comprising: plural overlappable element cam means coupled together for substantially parallel rotation about parallel but offset plural transverse axes for connecting said actuating means to said operating means and converting the rotary action of said actuating means to the reciprocating action of the operating means and thereby reciprocating said dead bolt.

2. A dead bolt latch construction according to claim 1 wherein: said cam means are coupled for substantially parallel rotation throughout their operating range by idler means.

3. A dead bolt latch construction according to claim 1 wherein: said cam means independently and alternately contact a cam surface on said operating means and each other for substantially effecting both additional bolt throw and means for effecting a plurality of backset possibility.

4. A dead bolt construction according to claim 1 wherein: spring means are provided to coact with said cam means to effect position and feel of said dead bolt in operation from its retracted to its extended position and vice versa.

5. A dead bolt construction according to claim 1 wherein: said operating means is provided with locking cam means which cooperate with said plural coupled overlapping element cam means to secure said dead bolt in its forward extended position.

6. A dead bolt construction according to claim 1 wherein: said operating means is provided with locking cam means which cooperate with said plural coupled overlapping element cam means to secure said dead bolt in its rearward retracted position.

7. A dead bolt construction according to claim 5 wherein: said operating means is of one piece construction with said dead bolt and wherein said operating means is a rigid extension of said dead bolt.

* * * * *